United States Patent [19]

Backus

[11] 4,337,683

[45] Jul. 6, 1982

[54] SYNTHETIC WOODWIND INSTRUMENT REED AND METHOD FOR ITS MANUFACTURE

[76] Inventor: John G. Backus, 2233 Via Guadalana, Palos Verdes Estates, Calif. 90274

[21] Appl. No.: 171,168

[22] Filed: Jul. 22, 1980

[51] Int. Cl.[3] ..... G10D 9/02

[52] U.S. Cl. ..... 84/383 A; 84/452 P

[58] Field of Search ..... 84/383, 293, 452 R, 84/452 P

[56] References Cited

U.S. PATENT DOCUMENTS

| | | | |
|---|---|---|---|
| 3,759,132 | 9/1973 | Backus | 84/383 A |
| 3,905,268 | 9/1975 | Gamble | 84/383 R |
| 4,084,476 | 4/1978 | Rickard | 84/293 |

*Primary Examiner*—Lawrence R. Franklin

*Attorney, Agent, or Firm*—Edward A. Sokolski

[57] ABSTRACT

A synthetic woodwind reed for use in woodwind instruments such as clarinets, oboes and bassoons. The reed is formed from a plurality of spaced longitudinal ribs fabricated of a graphite reinforced epoxy resin having a high modulus of elasticity and a low density. The spaces between the ribs are filled with a low density binder material such as a suitable epoxy resin preferably filled with small hollow plastic spheres, such as microballoons. A plastic film of a material such as Mylar is cemented to one or both sides of the reed to strengthen the structure. The width of the ribs, particularly at the tip portions thereof, and the number of ribs employed are chosen so that the finally formed and assembled reed has the proper modulus of elasticity and the proper density to provide an optimum natural vibration frequency for the reed, which should be 2000 Hz or higher.

9 Claims, 11 Drawing Figures

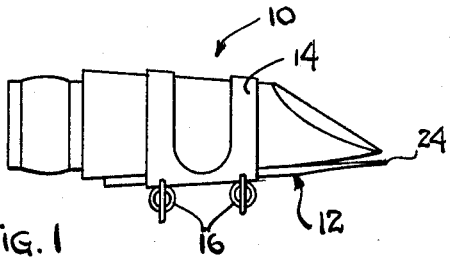
FIG. 1
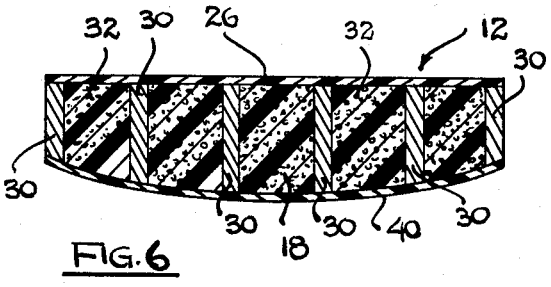
FIG. 6
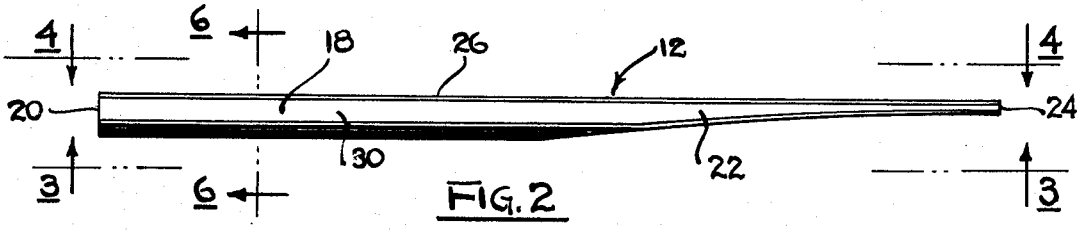
FIG. 2
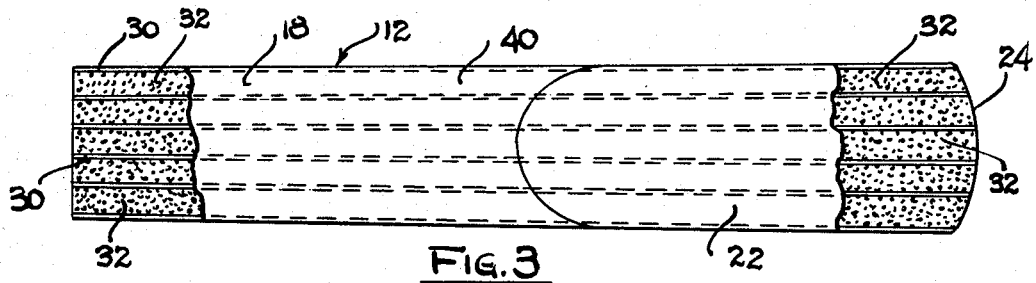
FIG. 3
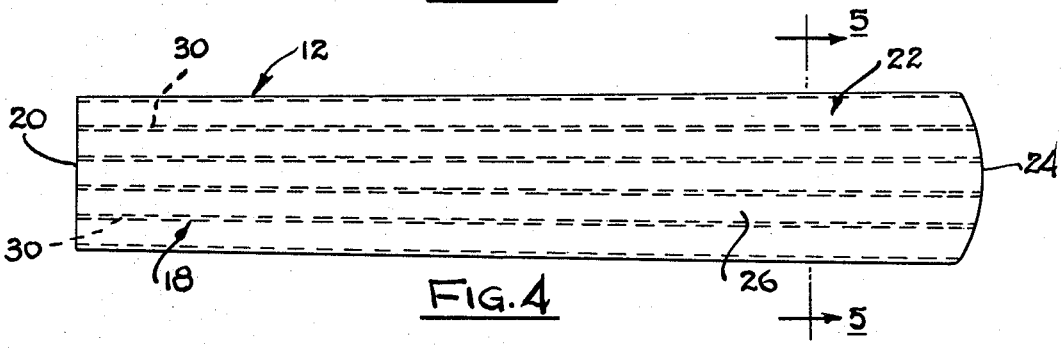
FIG. 4
FIG. 5
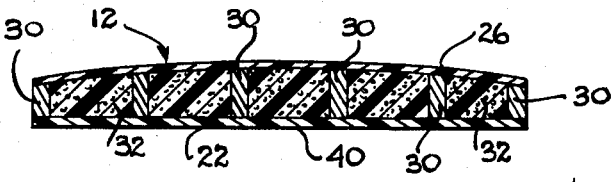
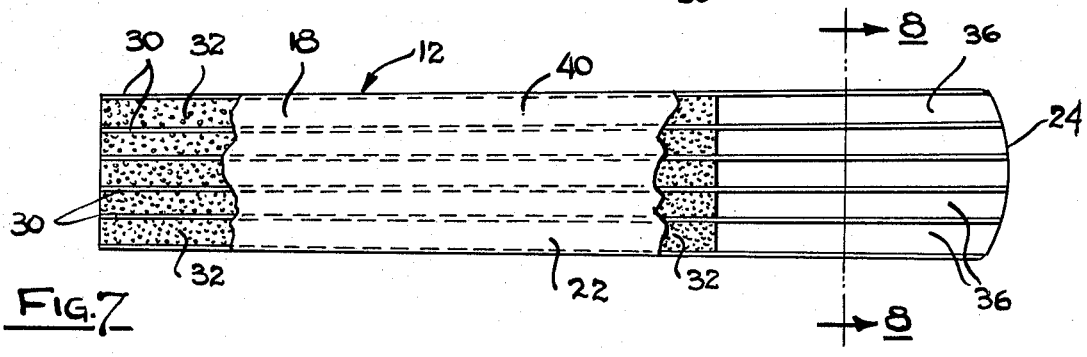
FIG. 7

SYNTHETIC WOODWIND INSTRUMENT REED AND METHOD FOR ITS MANUFACTURE

This invention relates to reeds for use in woodwind instruments, and more particularly to such a reed fabricated from a synthetic material comprising graphite reinforced epoxy resin.

Reed excited woodwind instruments which include the clarinet, oboe, and bassoon, traditionally use for their reed material a naturally growing cane identified by the botanical name *Arundo Donax*. This material has the desirable characteristics of high modulus of elasticity combined with a low density. Attempts to make woodwind instrument reeds from synthetic materials have not had any great degree of success due to the fact that it has not been possible to closely simulate in such a synthetic reed the desirable characteristics of the natural reed. The natural reed, while providing the desired tonal characteristics, has a number of disadvantages. First, such natural reed material has a very limited life. Further, as is true for most natural materials, it is difficult to provide close predictability as to the characteristics of natural reeds, and therefore some care must be taken in the choice and fabrication of such reeds to assure that they have the desired characteristics.

The desirable characteristics of a reed material may be understood by considering the clarinet or other woodwind instrument together with its reed. A natural reed is a piece of cane which is flat on one side and curved over about half of its length on the other side to produce the "vamp" portion which tapers from about $\frac{1}{8}''$ thick at its beginning near the center of the reed to some 5–7 mils thick at its vibrating tip end. When the reed is clamped to the mouthpiece, there is a gap of about 40 mils between the tip of the reed and the tip of the mouthpiece so that when the player blows into the mouthpiece to set the reed and the associated air column into vibration, there is about a $\frac{3}{8}''$ portion of the reed free to vibrate inside the player's mouth. It is this tip portion of the reed that is of great importance in determining the ease of playing and the tonal quality of the instrument. The instrument cannot readily be made to play a frequency higher than the natural frequency of the reed tip, so if this frequency is too low these higher notes either cannot be played or are playable only with an undesired altering of the player's embouchure. Measurements of the natural frequency of cane reed tips under playing conditions show that this natural frequency is on the order of 2200–2300 Hz for a wet cane reed. Tests made on reed cane show that the modulus of elasticity and the density vary considerably, not only for different samples of cane, but also for different sections of the same piece of cane. This variability is responsible for the fact that different cane reeds have such different playing characteristics so that the musician must usually try many reeds to find one that plays well. However, the average of a number of measurements for satisfactorily operating cane reeds indicates a Young's modulus of about $5\times10^{11}$ dynes per square centimeter and a density of about 0.7 grams per cubic centimeter.

The natural frequency, $f_n$, of the reed tip is given by the following expression:

$$f_n = K\sqrt{\frac{E^{\frac{1}{2}}}{\rho}}$$

wherein K is a constant which depends on the dimensions of the reed, E is the Young's modulus of the material and $\rho$ is the density of the material.

In applying Equation (1), it has been found that most materials have natural reed frequencies which are much too low (i.e., below 2000 Hz) for practical use as a reed. For example, most plastics, while they have low densities, also have low elastic moduli. Of the metals, it has been found that magnesium comes close to providing a playable reed (with embouchure adjustment needed for the high notes), this material having a natural frequency of about 1800 Hz. However, it has been found that magnesium reeds tend to accentuate high harmonics in the tone, in view of the fact that magnesium has a relatively high "Q" (i.e., it is a relatively low loss material) as compared with cane reeds. While it would be possible to coat magnesium reeds with a "lossy" material to reduce this effect, this would also increase the mass of the reed and its density with a corresponding lowering of the natural reed frequency, which of course would defeat the original objective of obtaining a resonant frequency close to 2200 Hz. A reed which is fabricated with metallic ribs, which in the preferred embodiment are specified to be of magnesium, is described in my U.S. Pat. No. 3,759,132, issued Dec. 18, 1973. Reeds fabricated of plastic and/or steel are described in my U.S. Pat. No. 3,420,132, issued Jan. 7, 1969.

The present invention provides an improvement over that of my aforementioned U.S. Pat. No. 3,759,132 and over cane reeds in affording a reproducible predictable reed having an optimum natural frequency. This end result is achieved by fabricating the reed with a structure which incorporates a plurality of strip elements of a graphite material which is specially cured and processed. The graphite ribs are spaced from each other and retained in a binder of low density filler material, such as a suitable epoxy resin filled with small hollow plastic spheres (known in the trade as "microballoons"). The number of ribs employed and the width of these ribs are chosen to provide in the finished reed the desired natural frequency. In one embodiment of the invention, the binder or filler material is placed between the ribs for the entire longitudinal extent of the reed, while in another embodiment of the invention, the filler material is omitted from the tip portion (vibrating portion) of the reed. It is to be noted that an advantage of the graphite material employed is that it has a loss factor which compares favorably to that of natural cane so that reeds made of this material do not have a sharp resonance and do not undesirably accentuate harmonics of the tone, as has been found with less lossy materials used in the prior art. It is further to be noted that while the preferred embodiment employs graphite fibers, other fibers having a high elastic modulus such as boron could also be employed.

It is therefore an object of this invention to provide a synthetic reed for a woodwind instrument having a desired natural frequency characteristic which is readily reproducible.

It is a further object of this invention to provide a synthetic reed for a woodwind instrument having the desired natural frequency characteristics which is more durable than natural cane reeds.

Other objects of the invention will become apparent as the description proceeds in connection with the accompanying drawings of which:

FIG. 1 is a side elevational view illustrating the reed of the invention installed in the mouthpiece of a woodwind instrument;

FIG. 2 is a side elevational view of a preferred embodiment of the invention;

FIG. 3 is a plan view of the preferred embodiment of the invention taken along the plane indicated by 3—3 in FIG. 2;

FIG. 4 is a plan view of the preferred embodiment of the invention taken along the plane indicated by 4—4 in FIG. 2;

FIG. 5 is a cross-sectional view taken along the plane indicated by 5—5 in FIG. 4;

FIG. 6 is a cross-sectional view taken along the plane indicated by 6—6 in FIG. 2;

FIG. 7 is a plan view corresponding to the view of FIG. 4 illustrating a second embodiment of the invention;

Figure 8:
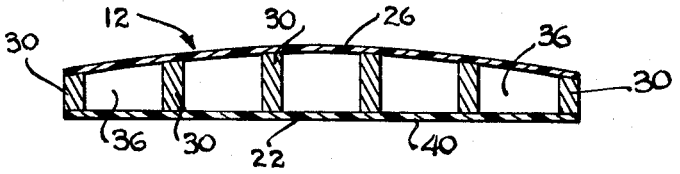
FIG. 8 is a cross-sectional view taken along the plane indicated by 8—8 in FIG. 7.

Referring now to FIGS. 1-6, a first embodiment of the invention is illustrated. Reed 12 is attached to a woodwind instrument mouthpiece 10 in a conventional manner by means of the ligature 14 which is tightened by means of screws 16. The reed, which is synthetically fabricated, has a vamp portion 22 which is tapered towards its tip end 24 and a body portion 18 which has substantially a uniform longitudinal thickness. The reed is formed from a plurality of longitudinal ribs 30 which extend throughout the entire length of the reed and are spaced from each other in substantially parallel relationship. In the preferred embodiment, these ribs are fabricated of a graphite reinforced epoxy resin having a high modulus of elasticity and a relatively low density. A particular such material which is commercially available is Magnamite type AS/3501-6, manufactured by Hercules Incorporated, Magna, Utah.

The ribs 30 are held together in spaced relationship by means of filler material 32 having a relatively low density such as a catalyzed epoxy resin mixed with a "lightening" material such as microballoons (small hollow plastic spheres). Outer skins 26 and 40 formed of a ½-1 mil Mylar film are cemented to one or both of the opposite broad surfaces of the reed to provide structural reinforcement for the reed.

The length of the reed is chosen to be the same as for conventional cane reeds, as is the shaping of the reed. The length and thickness of the ribs and the number thereof utilized are chosen to provide an optimum modulus of elasticity in the following manner (in accordance with Equation 1 above). As indicated in the discussion earlier in the specification, an average Young's modulus for good cane reeds is about $5\times10^{11}$ dynes per square centimeter. This, of course, assumes a particular thickness contouring of the reed wherein the body portion of the reed is ⅛" thick while the vamp tapers from the body portion to a tip thickness of about 6 mils. The width of the typical cane reed is about 0.5 inches. By employing graphite material, which has a modulus of elasticity of $80\times10^{11}$ dynes per square centimeter, it can be seen that to produce the same modulus of elasticity as the natural cane, the total width of the ribs should be 80/5, or 1/16th of the total width of the reed. It is to be noted in this regard that the reed only bends longitudinally. For a reed having a width of 0.5", therefore the total width of the graphite ribs should be 31 mils. Employing cured graphite material for the ribs having a sheet thickness of about 5 mils, as in the preferred embodiment, makes for a requirement of 6 ribs of this thickness to afford the optimum desired modulus of elasticity. The ribs can be made from sheets which are thicker or thinner (making for wider or narrower ribs) in which case a different number of ribs would be needed: for example, if we employed four ribs, they would each have to be 8 mils wide; 8 ribs would have to be 4 mils wide. Also, the desired end results could be achieved by varying the reed tip thickness; for example, with a tip thickness of 7 mils we could use five ribs 4 mils wide, or with 8 ribs 6 mils wide we could decrease the tip thickness to 5 mils. (It should be noted that the stiffness of the top of the reed is proportional to the cube of the tip thickness.)

The filler material 32 is preferably of an epoxy resin filled with a material called "microballoons" which consists of hollow plastic spheres a few mils in diameter. The epoxy is filled with the microballoons so as to give a density of about 0.7 grams per cubic centimeter to provide a low density filler material so as to make the average density of the reed approximately the same as that for natural cane. With a reed width of 5", it has been found that with more than 8 ribs used, the spaces therebetween are too small to fill easily, while with less than 4 ribs the spaces are too wide to afford the needed lateral strength. Therefore, as a practical matter the use of 6 ribs has been found to be ideal. To reinforce the structure in view of the fragility of the filler material, plastic films 26 and 40 preferably are cemented to the bottom and top surfaces respectively of the reed. These films may be of Mylar ½ to 1 mil in thickness. The top film 40 may be omitted or replaced by a different film, depending on the "feel" of the reed to the player.

Referring now to FIGS. 7 and 8, a second embodiment of the invention is illustrated. This second embodiment is the same as the first except for the fact that the plastic filler material between the ribs is eliminated from most of vamp portion 22. Thus, as shown in FIGS. 7 and 8, air spaces are left between the ribs for approximately one-third of the total length of the reed in the portion thereof running from the tip of the reed 24 to a point close to the base portion 18 thereof. As for the previous embodiment, a skin 26 and 40 covers the top and bottom surfaces of the reed, this skin being formed of a thin film of Mylar which is cemented to the reed, thus forming a structure with hollow spaces 36 between the ribs at the vibrating tip end thereof. The base portion 18 and the rear of the vamp portion have epoxy resin filler, as for the previous embodiment; since this part does not vibrate, its density is immaterial, and the microballoons may be omitted.

Figure 9:
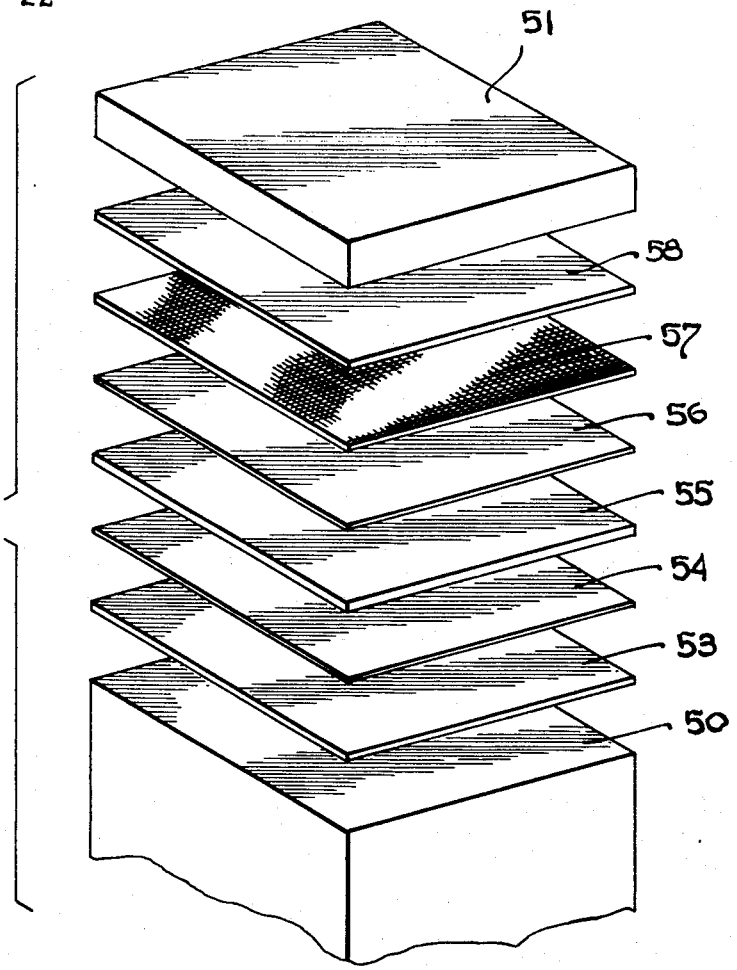
FIG. 9 is a schematic view illustrating steps in the fabrication of the device of the invention.
Figure 10:
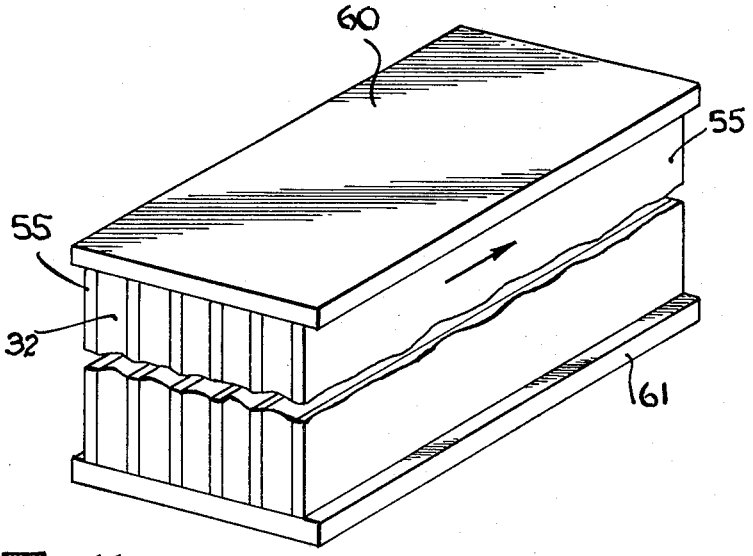
FIG. 10 is a schematic drawing illustrating a further step in the fabrication of the device of the invention.
Figure 11:
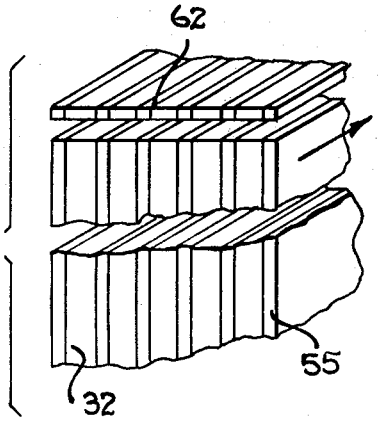
FIG. 11 is a schematic drawing illustrating a still further step in the fabrication of the device of the invention.

Referring now to FIGS. 9-11, a preferred method for fabricating the reeds of the present invention is schematically illustrated. A metal base plate 50 0.25-0.50" in thickness and about 3" square is used as the bottom support for a sandwich structure and a metal plate 51 3" square having a thickness of 0.030 thickness is used as the top plate therefor. Sandwiched between these two plates successively are a sheet of Teflon 53 which is 2-5 mils thick; a Teflon-coated glass release fabric layer 54 (e.g. Enfab TX10-40, manufactured by the Pallflex Corporation); a sheet 55 of graphite reinforced epoxy 7 mils thick (Magnamite high modulus graphite epoxy resin, type AS/3501-6, manufactured by Hercules Incorporated, Magna, Utah—or equivalent); another layer of Teflon-coated glass release fabric 56 similar to layer 55; a layer of glass cloth 57, 5 mils thick; a layer of Teflon 58, 2–5 mils thick similar to layer 53. The sandwich assembly of FIG. 9 is enclosed in an air-tight, heat-resistant plastic bag and the bag connected to a vacuum pump to remove air therefrom. The air is withdrawn to a vacuum of 30" of mercury, so that the external atmospheric pressure applied to the plastic bag compresses the assembly with a pressure of 15 pounds per square inch to join the layers together. The entire assembly is then placed in an oven and heated at 300° F. for two hours. After having been permitted to cool, the graphite reinforced epoxy sheet is removed from the assembly, the sheet now being cured and in a rigid state. It should be noted that several of the assemblies described above may be incorporated in the sandwich structure, so that several graphite sheets may be cured at the same time.

Referring now to FIGS. 10 and 11, the reed blanks are fabricated in the following manner: The number of graphite sheets 55 to be used in forming the reeds are supported on their opposite edges between the plates 60 and 61 of a holding jig which retains the sheets in a parallel spaced relationship with the distance between the broad surfaces of the outermost sheets being equal to the total desired width dimension of the finished reed (typically about 0.5"). The sheets are oriented with the graphite fibers parallel to the plates 60 and 61 as shown by the arrow in FIG. 10. The filler material 32 which is a low density catalyzed epoxy resin mixed with a light material such as microballoons, 0.002–0.005" in diameter, is then forced into the spaces between the graphite sheets. The epoxy resin material is then cured by placing the assembly in an oven and heating it to the appropriate temperature. After having been cured, the structure is then sawed in the direction of the graphite fibers into strips 62 about ⅛" thick. Each strip 62 is a reed blank which is then shaped into a reed, as shown in FIGS. 1–6. After the reed has been so shaped, a Mylar coating is cemented to either one surface or both of the opposite surfaces of the reed is provide structural reinforcement therefor, as shown in FIGS. 2–6.

To produce a reed of the embodiment of FIGS. 7 and 8, which has air spaces between the ribs at the tip portion thereof, a method such as just described is followed; however, the spaces between the graphite sheets are only filled from the base to a point about two-thirds of the distance between the butt end of the reed and the tip end thereof, with the ribs projecting out of the blank at the tip end. After these blanks are cut to a ⅛" thickness, as previously described, while employing an appropriate jig to hold the free ribs in place, the plastic surface sheets (Mylar film) are cemented to the opposite surfaces of the reed, thus forming a reed structure with hollow spaces between the ribs at the vibrating tip end thereof.

As already noted, while the invention has been described specifically in connection with the fabrication of a clarinet reed, the same techniques can be utilized for forming reeds for other woodwind instruments employing the design considerations peculiar to each such particular design.

While the invention has been described and illustrated in detail, it is to be clearly understood that this is intended by way of illustration and example only and is not to be taken by way of limitation, the spirit and scope of this invention being limited only by the terms of the following claims.

I claim:

1. A synthetic woodwind reed formed with a vamp and base portion comprising a plurality of substantially parallel longitudinal rib members fabricated of epoxy resin reinforced with a material selected from the class consisting of graphite and boron and having a high modulus of elasticity, a low density and a loss factor comparable to that of natural cane (Arundo Donax), a low density binder material in the spaces between said ribs for binding said ribs together, the number of said ribs and the width thereof being chosen to make for an effective modulus of elasticity and density for the reed so as to afford a natural vibration frequency thereof of at least 2000 Hz.

2. The reed of claim 1 wherein said ribs are fabricated of a cured graphite reinforced epoxy resin.

3. The reed of claim 2 wherein the total width of said reed is approximately 0.5 inches, the number of said ribs being six, each having a width of 4–6 mils.

4. The reed of claim 1 or 3 and additionally including a thin plastic sheet covering at least one of the opposite broad surfaces of said reed.

5. The reed of claim 4 wherein filler material is omitted from a predetermined substantial part of the vamp portion of the reed to leave air spaces between the ribs in said part of the vamp portion.

6. The reed of claim 5 wherein said predetermined part of the vamp portion comprises substantially one-third of the total length of the reed running from the tip thereof towards said base portion.

7. The reed of claims 1 or 3 wherein said binder material has microballoons therein to decrease the density thereof.

8. A method for fabricating synthetic woodwind reed blanks comprising the steps of sandwiching between a pair of metal plates successive sheets of Teflon (2–5 mils thick), a Teflon coated glass release fabric, graphite reinforced epoxy (7 mils thick), a Teflon coated glass release fabric, a layer of glass cloth, and a layer of Teflon (2–5 mils thick) to form a sandwich assembly, confining said sandwiched assembly in an air-tight container, evacuating said container to substantially 30 inches of vacuum, heating the evacuated container at 300° F. for approximately two hours to cure the graphite reinforced epoxy, permitting the sandwich assembly to cool to room temperature (approximately 20° C.), removing the graphite reinforced epoxy sheet from the assembly, making a plurality of additional graphite reinforced epoxy sheets as described in the preceding steps, supporting said graphite reinforced epoxy sheets in substantially parallel spaced relationship opposite each other, filing the spaces between said sheets with a low density binder material, curing said binder material to form a composite from sheets and binder material, and sawing through the composite in planes substantially normal to the broad surfaces of said sheets to form said reed blanks.

9. The method of claim 8 wherein the spaces between the sheets are filled with epoxy resin having microballoons (small hollow plastic spheres) therein.

* * * * *